United States Patent [101]

Hutchins

[11] 4,052,824

[45] Oct. 11, 1977

[54] ABRADING TOOL SUCTION SYSTEM

[75] Inventor: Donald H. Hutchins, Sierra Madre, Calif.

[73] Assignee: Hutchins Manufacturing Company, Pasadena, Calif.

[21] Appl. No.: 745,656

[22] Filed: Nov. 29, 1976

[51] Int. Cl.[2] ..... B24B 23/00; B24B 55/06

[52] U.S. Cl. ..... 51/170 MT; 51/273

[58] Field of Search ..... 51/170 MT, 170 R, 170 TL, 51/268, 273

[56] References Cited

U.S. PATENT DOCUMENTS

| | | | |
|---|---|---|---|
| 3,785,092 | 1/1974 | Hutchins | 51/170 MT |
| 3,932,963 | 1/1976 | Hutchins | 51/170 TL |

*Primary Examiner*—Harold D. Whitehead

*Assistant Examiner*—Roscoe V. Parker

*Attorney, Agent, or Firm*—William P. Green

[57] ABSTRACT

A portable abrading tool having a shoe which is driven relative to a carrying body by a contained air motor to perform an abrading operation, and in which a flow of air discharged from the motor passes through a conduit structure projecting from an end wall of the tool body, with the body having a flange projecting therefrom beneath the conduit structure and carrying at its underside a seal part slidably engaging the shoe structure to deliver air and abraded particles from a passage in the shoe through the seal part and upwardly through a connected secondary conduit for delivery into the primary stream from the motor, in an aspirator relation inducing the secondary flow by the energy of the primary stream.

14 Claims, 8 Drawing Figures

FIG. 1
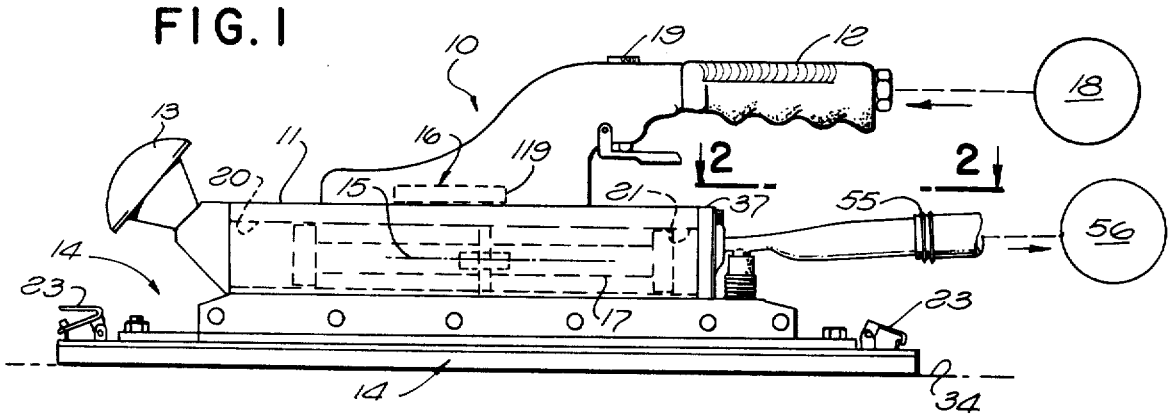
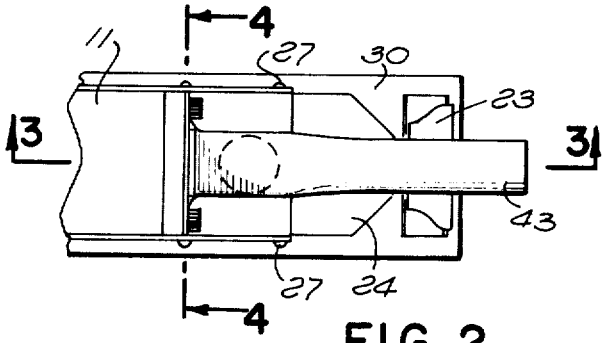
FIG. 2
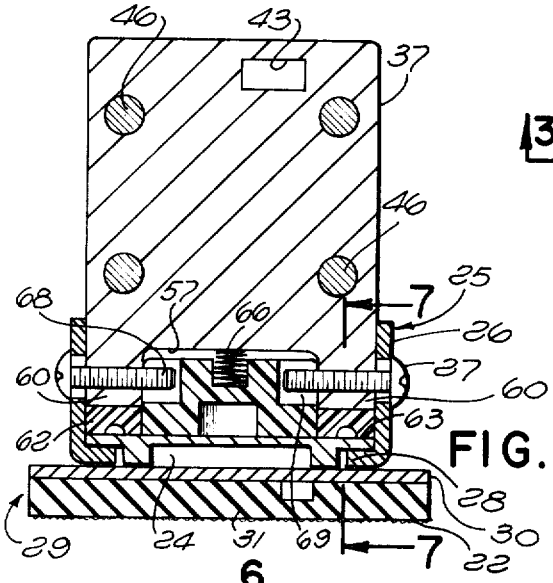
FIG. 4
FIG. 3
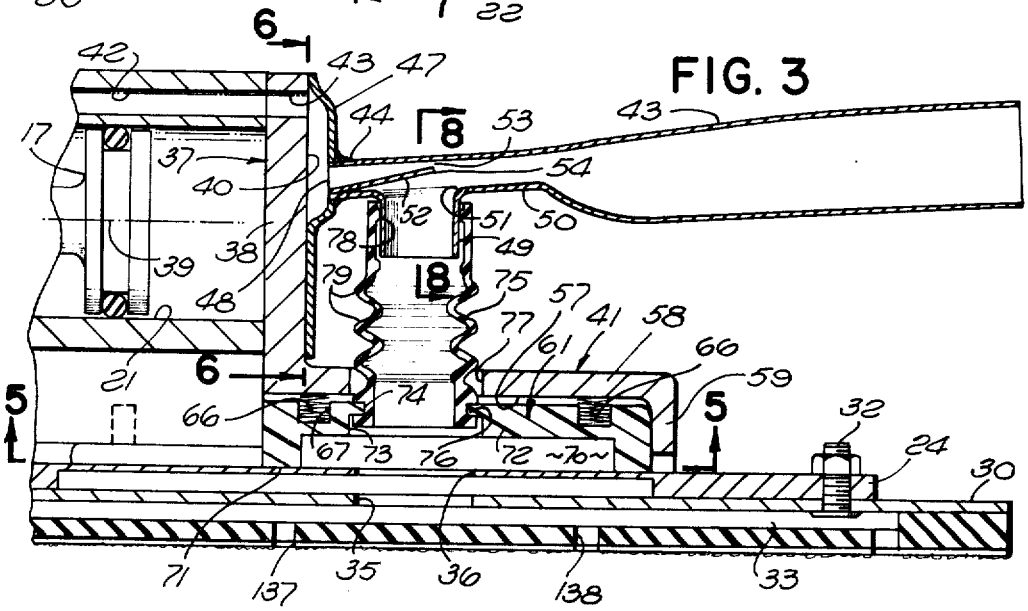

FIG. 5
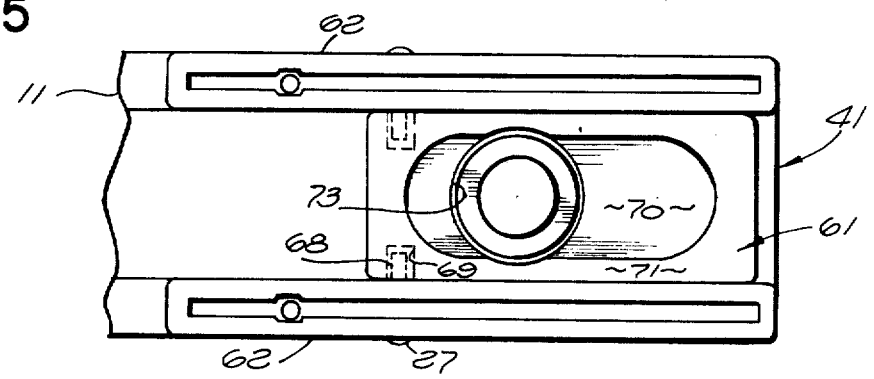
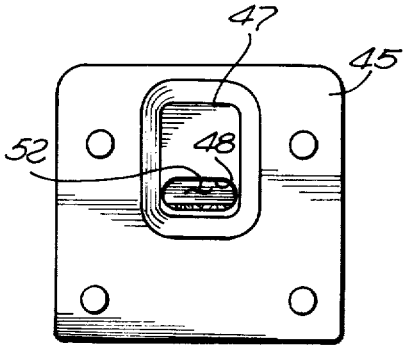
FIG.6
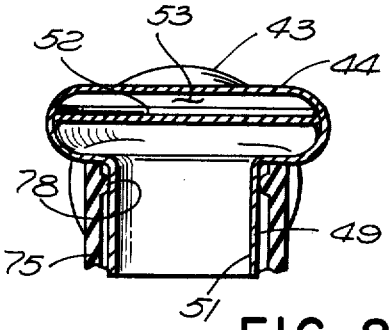
FIG. 8
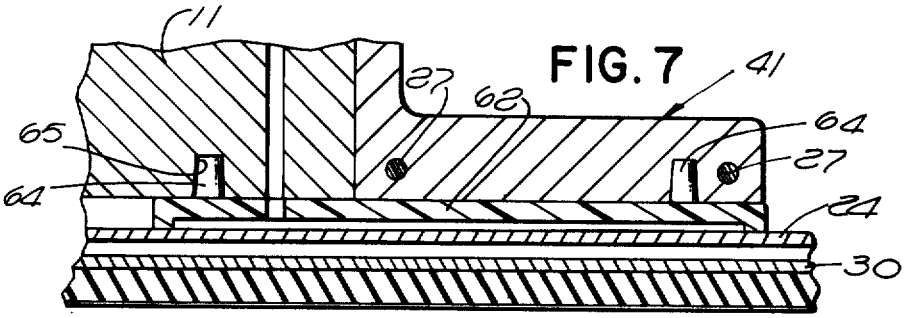
FIG. 7

ABRADING TOOL SUCTION SYSTEM

BACKGROUND OF THE INVENTION

This invention relates to improved portable power driven abrading tools, such as sanders, of a type including an abrading shoe power driven relative to a carrying body to cause a sheet of sandpaper or other abrading material to perform an abrading operation on a workpiece.

In U.S. Pat. No. 3,785,092, there has been shown an abrading tool in which an aspirator is energized by a primary flow of air discharged from an air motor of a tool to induce a secondary flow of air and abraded particles from the vicinity of a workpiece through passages in the abrading shoe and into a conduit leading to a dust collection bag. A later U.S. Pat., No. 3,932,963, shows a similar dust collection system in a sander of a type in which the abrading shoe reciprocates in a straight line relative to the carrying body.

SUMMARY OF THE INVENTION

The present invention relates to an improved arrangement for conducting the primary and secondary flows of air, in a tool of the above discussed general type, into contact with one another at an aspirator location, in a manner attaining optimum confinement and control of the two streams, and avoiding development of leaks in either system even after very extended use of the tool. Certain features of the invention relate particularly to the manner in which the secondary flow of air and particles is conducted to the body of the tool from the relatively movable abrading shoe, in tightly sealed relation, and in a manner occupying a minimum of space.

In an arrangement embodying the invention, the body of the tool has an end surface from which there projects a conduit structure through which the primary flow of air discharged from the air motor of the device passes. Beneath the location of this conduit structure, the body of the tool has a flange which projects in generally the same direction as the conduit structure and is received above the abrading shoe. A seal part carried at the underside of the flange slidably engages the shoe in a relation conducting air from a passage or passages in the shoe through the seal part to a tube which extends upwardly to the first mentioned conduit structure, with an aspirator being provided at the juncture of this tube and the conduit structure for inducing the secondary flow of air and particles from the shoe in response to movement of the primary flow of air. The tube extending upwardly from the seal part is longitudinally extensible, desirably being a short length of corrugated flexible hose, and may extend upwardly through an opening in the flange and be connected at its lower end in fluid tight relation to the seal part and at its upper end in fluid tight relation to the conduit structure. The seal part at the underside of the flange is free for upward and downward movement relative to the flange to form an effective sliding contact seal with the shoe, and is preferably yieldingly urged downwardly against the shoe by spring means interposed vertically between the flange and seal part.

BRIEF DESCRIPTION OF THE DRAWINGS

The above and other features and objects of the invention will be better understood from the following detailed description of the typical embodiment illustrated in the accompanying drawings in which:

FIG. 1 is a side view of a straight line reciprocating sander constructed in accordance with the invention;

FIG. 2 is an enlarged fragmentary plan view taken on line 2—2 of FIG. 1;

FIG. 3 is a further enlarged fragmentary vertical front to rear section taken on line 3—3 of FIG. 2;

FIG. 4 is an enlarged transverse section taken on line 4—4 of FIG. 2;

FIG. 5 is a fragmentary sectional view taken on line 5—5 of FIG. 3;

FIGS. 6 and 8 are vertical sections taken on line 6—6 and 8—8 of FIG. 3; and

FIG. 7 is a vertical section taken on line 7—7 of FIG. 4.

DESCRIPTION OF THE PREFERRED EMBODIMENT

The portable sanding tool illustrated at 10 in FIG. 1 includes a body 11 adapted to be held by two handles 12 and 13, and to the underside of which there is mounted a shoe structure 14 which is power driven to reciprocate in a straight line relative to body 11 and along the front to rear axis of the device represented at 15. The motor 16 for reciprocating the shoe is contained within body 11, and typically includes a double ended piston illustrated somewhat diagrammatically at 17 to which compressed air is delivered from a source 18, under the control of a trigger actuated valve 19 and an automatic reversing valve 119 operated by the piston and acting to alternately admit compressed air to the two cylinder chambers 20 and 21 at opposite ends of the double ended piston. A reciprocating mechanism of this type is disclosed in the above mentioned prior U.S. Pat. No. 3,932,963, and will not be described in further detail in the present application.

The abrading shoe assembly 14 carries a sheet of sandpaper 22 at its underside, which is retained at its opposite ends by two spring clips 23. The shoe assembly may include a rigid essentially flat metal part 24 extending along the underside of body 11 and appropriately guided for only the desired straight line reciprocating movement by two retaining plates 25 extending along opposite sides of the body and having vertical portions 26 secured by screws 27 to the body, with inturned lower horizontal portions 28 of plates 25 extending beneath and slidably contacting the under surface of plate 24 to confine it slidably at the underside of the body. The shoe assembly 14 also includes a removable pad strucure 29 which may consist of an upper rigid metal plate 30 and a cushion 31 adhered to the underside thereof, with this two piece pad structure being secured by screws 32 to the underside of plate 24. Passages are formed in pad 31 to conduct air and abraded particles from the workpiece 34 through the interior of the rubber pad 31 to the locations of two vertically aligned openings 35 and 36 formed in plates 30 and 24 respectively near the rear end of the tool. More particularly, these passages within pad 31 may form a number of openings 138 in the bottom surface of the pad communicating with registering openings 137 in the sandpaper sheet 22, at a number of locations spaced across the horizontal extent of the cushion and sandpaper sheet, with these various openings 138 extending upwardly to a location near the plate 30 and there leading into or merging with a passage 33 which extends along the underside of plate 30 to the location of apertures 35 and 36. The two plates 24 and 30 are in direct contact with one another entirely about the locations of these apertures, to form a seal between the parts and prevent loss of vacuum at that location.

The cylinder bore 21 at the rear end of piston 17 (right end as viewed in FIG. 1) is closed by an end part 37 of the body. More particularly, this end part has a vertical upstanding portion 38, which is disposed transversely of the main front to rear axis 15 of the tool, and axis 39 of the piston, and which has a planar rear end surface 40 also disposed transversely of those axes. At the lower end of this portion 38, the part 37 has a flange 41 which extends horizontally and projects in a rearward direction beyond the plane of surface 40. The compressed air which is discharged from motor 16 within the body, after driving piston 17, flows to the rear end of the body through a passage 42 in the body which communicates with an aperture 43 in plate 38 for conducting the air, still under substantial super-atmospheric pressure, to the plane of the rear face 40. From this aperture, the pressurized air flows into a conduit or tube 43, whose forward end 44 is rigidly secured to and carried by a mounting plate 45 secured by screws 46 to end wall portion 38 of part 37. Mounting plate 45 may be flat except at the location of a rearwardly bulged or deformed region 47, which is shaped to communicate with both the aperture 43 and opening 48 in plate 45 leading into the forward end of tube 43. Plate 45 is in tight sealed engagement with rear surface 40 of end wall 38 of the body continuously about the location of bulge 47 and the communicating apertures 43 and 48, to form a seal between the parts at that location, and if desired may have an appropriate gasket between these elements for enhancing the seal.

The tube 43 may be angled slightly upwardly as seen in FIG. 3, and may be formed of simple straight cylindrical metal tubing having its forward end flattened to the essentially rectangular configuration illustrated in FIG. 8. A short metal tube 49 projects downwardly from the lower wall 50 of the rectangular portion of tube 43, near plate 45, to pass air and abraded particles from the shoe upwardly through a circular opening 51 in wall 50 into to the interior of tube 43. To attain an aspirator or ejector action, the primary flow of air from the motor is initially confined above a deflecting wall or plate 52, which extends across the width of the rectangular portion of tube 43 and is brazed to the opposite sides thereof, and which is inclined upwardly as seen in FIG. 3 to require that all of the air from the motor move along the upper side of plate 52 to a location 53 at which the air discharges rapidly rearwardly past a rear transverse edge 54 of plate 52 at a location above and slightly beyond the mild point of opening 51. As will be understood, this primary flow of air discharging rapidly rearwardly at 53 induces a secondary flow of air abraded particles upwardly through tube 49, by aspirator action, so that these two streams of air then intermix and flow rearwardly together through tube 43 and ultimately through a flexible hose 55 into a porous dust collection bag 56 or other dust collection chamber.

At its underside, flange 41 contains a rectangular recess 57, having an upper horizontal wall 58, a transverse vertical end wall 59, and two opposite parallel side walls 60. Confined within this recess, there is provided a seal element 61, which is externally of a rectangular configuration to fit closely within recess 57, while being free for very limited and slight upward and downward movement relative to the flange 41. At opposite sides of recess 57 and part 61, two elongated parallel bearing strips or elements 62 are interposed vertically between flange 41 and the upper planar surface 63 of shoe plate 24, with these bearing elements typically being formed of an appropriate resinous plastic material and being located in fixed position relative to part 37 and the remainder of the tool body 11 by projections 64 formed integrally with bearing elements 62 and extending upwardly into mating recesses 65 formed in flange 41 and the main portion of the body. An additional pair of bearing strips similar to elements 62 may be provided at the forward end of the tool for assisting in slidably guiding the shoe for its reciprocating movement at that location. The seal plate 61 is yieldingly urged downwardly against upper surface 63 of plate 24 by a pair of light coil springs 66 whose lower portions are received and confined within recesses 67 formed in the upper surface of part 61, and whose upper ends bear upwardly against top wall 58 of recess 57 in flange 41. Two of the screws 27 which secure the two shoe retaining plates 25 on the opposite sides of the body may extend through side portions of the end part 37 and at their ends 68 project into notches 69 formed in the opposite sides of part 61 in an interfitting relation preventing movement of part 61 relative to flange 41 in a direction parallel to the front to rear axis 15 of the tool.

As seen in FIG. 5, the seal part 61 has at its underside a recess 70, which may be elongated in a front to rear direction to always communicate with aperture 36 in the engaged plate 24, and thereby receive air and abraded particles through that aperture from the shoe. In all positions of the shoe, the horizontal planar undersurface 71 of part 61 contacts the upper surface of part 24 entirely about aperture 36, to form an effective airtight seal between the relatively movable parts at that location.

The upper wall 72 of part 61 contains a circular aperture 73 defined by an annular inwardly projecting rib or edge 74. A flexible tube or hose 75 connects into this opening 73, and has at its lower end an external annular groove 76 receiving edge 74 in a closely interfitting relation forming a fluid tight seal between the parts at that location. The tube 75 is desirably formed of an appropriate flexible elastomeric material, such as neopreme rubber, and above the location of the part 61 this tube projects upwardly through a circular opening 77 formed in the top part of flange 41. At its upper end, tube 75 is received tightly about the rigid short tube 49 projecting downwardly from conduit 43. To form an effective fluidtight seal at that location, the upper portion of the elastomeric tube 75 has an internal annular rib 78, which is of a normal diameter slightly less than the external diameter of tube 49 to fit tightly thereon. Vertically between its upper and lower portions, the hose or tube 75 has an intermediate portion with annular corrugations or ribs 79 giving the tube a capacity for very substantial axial or vertical extensibility or contractability, so that the lower end of this tube and the connected part 61 may move slightly upwardly and downwardly relative to flange 41 and the upper conduit structure 43 to always assure maintenance of a close sliding engagement between seal part 61 and the upper surface of shoe plate 24. The seal part 61 is desirably rigid, and may be formed of appropriate resinous plastic material capable of withstanding wear and maintaining the seal after long use.

During use of the tool, compressed air is fed continuously from source 18 to motor 16, causing piston 17, acting through an appropriate gear mechanism, to reciprocate shoe 14 in opposite directions along axis 15.

The still pressurized air discharged from the motor flows through aperture 43 in the rear end wall 38 of the body, and then flows along the upper side of deflector 52 to discharge rearwardly at 53 and induce a secondary flow of air through passages 33, 137, 138 and 33 in the sandpaper sheet and shoe assembly 14 and through apertures 35 and 36 in plates 30 and 24 into the recess 70 formed in the underside of seal part 61. From this recess, the secondary flow of air and abraded particles carried thereby flow upwardly through tube 75 and the connected short tube 49 into conduit 43 for intermixture with the primary flow of air and delivery therewith to bag 56, through whose pores the air flows to atmosphere while the dust is trapped therein.

While a certain specific embodiment of the present invention has been disclosed as typical, the invention is of course not limited to this particular form, but rather is applicable broadly to all such variations as fall within the scope of the appended claims.

I claim:

1. A portable abrading tool comprising:

a body to be held by a user;

a shoe structure adapted to carry a sheet of abrading material and mounted to the underside of said body for abrading movement relative thereto, and containing passage means through which air and abraded particles are drawn from near the shoe structure;

an air motor in said body for driving the shoe relative to the body;

said body having an end surface facing in generally a predetermined direction, and said body having a flange projecting in said direction beyond said end surface at a location near but above said shoe structure;

a conduit structure carried by said body and into which a primary flow of air discharged from said motor passes, said conduit structure projecting from said body in said predetermined direction and beyond said end surface at a location spaced above said flange;

a seal part carried at the underside of said flange and free for slight upward and downward movement relative thereto and relative to said conduit structure and containing a passage communicating with said passage means in the shoe structure to receive air and particles therefrom; said seal having an undersurface slidably engaging an upper surface of said shoe structure about said passage means and said passage to form a seal therebetween as the shoe structure moves relative to the flange and seal part;

additional conduit means extending upwardly from said seal part past said flange and connected to said first mentioned conduit structure;

said conduit structure forming at the upper end of said additional conduit means an aspirator by which said primary flow of air induces a secondary flow of air and particles from said shoe structure and through said additional conduit means for intermixture with and discharge with the primary flow.

2. A portable abrading tool as recited in claim 1, in which said additional conduit means is longitudinally extensible and contractable to enable slight upward and downward movement of said seal part relative to said conduit structure.

3. A portable abrading tool as recited in claim 1, in which said additional conduit means includes a flexible longitudinally extensible and contractable hose extending upwardly from said part to said conduit structure.

4. A portable abrading tool as recited in claim 1, including means yieldingly urging said seal part downwardly relative to said flange and against said shoe structure.

5. A portable abrading tool as recited in claim 1, including springs interposed vertically between said flange and said seal part, and yieldingly urging the seal part downwardly relative to the flange and against said shoe structure.

6. A portable abrading tool as recited in claim 1, in which said seal part is a rigid part contained and confined within a recess formed at the underside of said flange, said additional conduit means including a flexible longitudinally extensible hose extending upwardly from said seal part and through an opening in said flange and connecting at its upper end to said conduit structure.

7. A portable abrading tool as recited in claim 6, in which said seal part has an upper wall containing an opening forming a portion of said passage, said flexible hose having a lower portion received within said opening and containing a peripheral groove, said top wall of said seal part having an annular edge received within said peripheral groove in said lower portion of said hose in a sealed interconnecting relation.

8. A portable abrading tool as recited in claim 7, in which said conduit structure has a short tube projecting downwardly therefrom, said hose having an upper portion received about said short tube and having an internal annular seal rib engaging the short tube in sealed relation.

9. A portable abrading tool as recited in claim 8, in which said hose has a longitudinally extensible corrugated portion vertically between said lower and upper portions thereof.

10. A portable abrading tool as recited in claim 9, in which said body includes an end member having an upstanding portion forming an end wall of the body and carrying said conduit structure and integral with said flange.

11. A portable abrading body as recited in claim 10, including two elongated parallel bearing elements at the underside of said flange, and at opposite sides of said seal part, and slidably engaging said shoe structure.

12. A portable abrading tool as recited in claim 1, including two elongated parallel bearing elements carried at the underside of said flange and at opposite sides of said seal part and slidably engaging said shoe structure in bearing relation.

13. A portable abrading tool as recited in claim 1, in which said body includes an end part having an upstanding portion which forms an end wall of the body and which has said end surface formed thereon, and which is integral with said flange, and which contains an aperture through which air from the motor discharges to said conduit structure.

14. A portable abrading tool as recited in claim 13, in which said conduit structure has a mounting flange received against said end surface and secured to said upstanding portion of said end part and constructed to pass air from the motor into said conduit structure.

* * * * *